United States Patent [19]

Frisk et al.

[11] Patent Number: 4,908,101

[45] Date of Patent: Mar. 13, 1990

[54] METHOD AND APPARATUS FOR MIXING CHEMICALS INTO FIBER PULP

[75] Inventors: Edvin Frisk, Järved; Per-Olof Frisk, Arnäsvall; Arne Lindahl, Domsjö, all of Sweden

[73] Assignee: Hedemora AB, Hedemora, Sweden

[21] Appl. No.: 119,703

[22] Filed: Nov. 12, 1987

[30] Foreign Application Priority Data

Nov. 18, 1986 [SE] Sweden ..... 8604918

[51] Int. Cl.[4] ..... B02C 19/22

[52] U.S. Cl. ..... 162/261; 241/247; 241/260.1; 366/305; 366/307; 366/329

[58] Field of Search ..... 162/261; 366/305, 307, 366/329; 241/247, 260.1

[56] References Cited

U.S. PATENT DOCUMENTS

| | | | |
|---|---|---|---|
| 2,969,960 | 1/1961 | Gurley, Jr. | 366/305 X |
| 3,653,637 | 4/1972 | Eckhardt | 259/7 |
| 3,685,804 | 8/1972 | Stansfield | 259/10 |
| 4,128,342 | 12/1978 | Renk | 366/305 X |
| 4,462,692 | 7/1984 | Meyer | 366/305 X |
| 4,638,954 | 1/1987 | Poss | 241/247 X |

*Primary Examiner*—Peter Chin
*Assistant Examiner*—Thi Dang
*Attorney, Agent, or Firm*—Fleit, Jacobson, Cohn, Price, Holman & Stern

[57] ABSTRACT

In a method and an apparatus for mixing chemicals into a fibre pulp, the pulp passes in a space between a fixed casing and a rotating device through three treatment sections. In the first treatment section a transport screw is arranged for transporting the pulp and impart to it a pressure up to the subsequent treatment section. In this treatment section both the casing and the rotating device are provided with guide elements which cause shearing between the fibre layers of the pulp by alternating velocity gradiants in the pulp and oscillating movement thereof. In the next treatment section the pulp is imparted a retarding velocity in a first part of the section and thereafter an accelerating velocity in a second part of the section during simultaneous oscillating movement and shearing between the fibre layers. This is accomplished by a configuration of both the fixed casing and the rotating device in the form of double-cones having their basis abutting each other.

6 Claims, 3 Drawing Sheets

METHOD AND APPARATUS FOR MIXING CHEMICALS INTO FIBER PULP

The present invention relates to a method and an apparatus for effectively mixing chemicals in solid or liquid state into substances having a dry content usually increasing 6%. The invention is particularly adapted for mixing chemicals into lignocellulose materials as chemical pulp, chemical mecanical pulp and mechanical wood pulp and also other kinds of pulp.

Upon bleaching cellulose material it becomes more and more usual to carry out the bleaching at high dry content or so called pulp concentration. The choice of high pulp concentration depends on the fact that the need of chemicals decreases and that the need of heat energy decreases. Moreover, investment cost is reduced owing to the fact that the process apparatus may have less dimensions. Furthermore, the detention time is decreased when using higher pulp concentration depending on the fact that the concentration of chemicals increases upon maintained or somewhat decreased charge in percent of the material.

From the above reasons it appears that it is desirable to bleach or carry out other chemical treatment at high pulp concentration. Thus, it is well known to carry out alcaline treatments at high pulp concentration in order to decrease the content of extractive matters and/or the content of hemicellulose in the pulp.

The greatest problem when bleaching and refining cellulose and other materials at high pulp concentration is to achieve a rapid and homogenious mixing of the chemicals into the material being treated. Great difficulties usually arise already at a dry content of about 10%. In practice it has shown to be almost quite impossible to mix in chemicals in a satisfactory way at concentrations above 18%. In those cases one has been fairly well successful in this respect, too high temperature has been obtained, which can result in decomposition of the chemicals. In other words, the advantage of having high dry content is lost. Still more serious is that a shortening of the fibres in the cellulose material is obtained. Another disadvantage in existing mixing apparatus is, that they are complicated in function and, furthermore, it is often difficult to replace worn machine parts. This results in long expensive production stand stills increasing the cost of the final product.

By the present invention the above problems have been eliminated or at least essentially reduced. By the invention an effective mixing of chemicals with cellulose or other substances is obtained. Moreover, by the invention a very homogenious distribution of the chemicals is obtained in the material with which they shall be mixed. Furthermore, unnecessary temperature increase is avoided, which makes it possible to keep the chemical consumption at a low level. Finally, it can be mentioned that a shortening of the fibres in the cellulose material is avoided.

The characteristics of a method and an apparatus according to the invention to obtain the above mentioned advantages appear from the appendent claims.

Embodiments of the invention are in the following described more in detail with reference to the accompanying drawings wherein.

Figure 1:
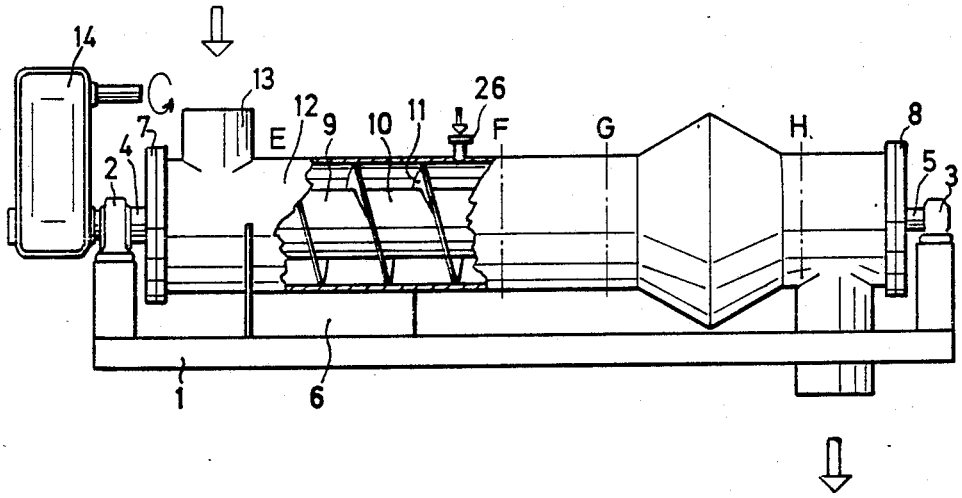
FIG. 1 illustrates a choosen embodiment of an apparatus according to the invention in side view and partly cut-out.

The apparatus shown in FIG. 1 is supported by a base 1 carrying bearings 2 and 3 having axle spindles 4 and 5, respectively. The base furthermore carries together with a support trestle 6 and sealing gables 7, 8 a fixed casing or tube mantle 12 which at one end is provided with an inlet 13 for the pulp to be treated and in the opposite end provided with an outlet 21 (see FIG. 4) for treated pulp. Rotatable parts are arranged within the mantle 12 with a space to the inner surface of the mantle along the apparatus. The rotatable parts are via the axle spindles 4,5 driven in a conventional way by a motor via gear box 14. Among these rotatable parts is in FIG. 1 shown a feed or transport screw 9 consisting of tube shaft 10 and worm 11. Finally, FIG. 1 shows a feed tube 26 for supplying chemicals. More than one such feed tube can be arranged.

During the treatment process the pulp is transported in said space between the fixed mantle and said rotatable parts from the inlet 13 through different treatment zones E-F, F-G and G-H up to the outlet 23.

Figure 2:
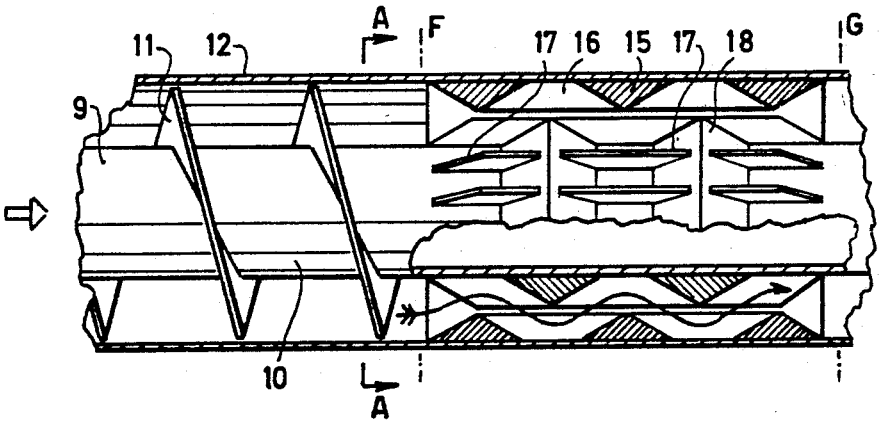
FIG. 2 illustrates in larger scale one treatment step in the mixing and treatment process carried out in the device shown in FIG. 1.
Figure 3:
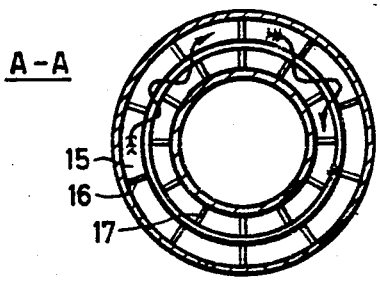
FIG. 3 is a sectional view taken along the line A-A in FIG. 2.

FIGS. 2 and 3 show the last part of the zone E-F but particularly illustrates a preferred embodiment of the treatment zone F-G. As shown the fixed mantle 12 is in this embodiment provided with fixed radial annually formed elements 15 having a substantially triangular cross section and these elements 15 are joined with axially extending but radially directed fixed guide plates 16. The elongated tube shaft 10 of the transport screw 9 is provided with axially extending but radially directed guide plates 17 and the tube shaft 10 is also provided with radially extending annular elements 18 having the same cross section as the annular elements 15. The fixed guide plates 16 are in number less than the rotatable guide plates 17. FIGS. 2 and 3 also by arrows illustrate the moment directions of the pulp in the treatment zone F-G.

Figure 4:
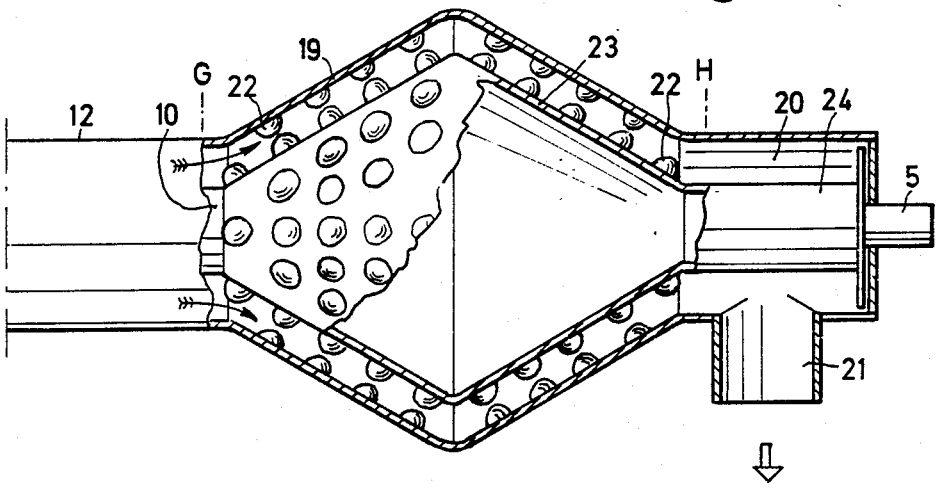
FIG. 4 illustrates, partly in section, another step in the treatment process carried out in the apparatus shown in FIG. 1.

FIG. 4 illustrates the last treatment zone G-H in the disclosed apparatus. The mantle 12 is connected to an outer fixed frustum of a double-conical casing 19 and the rotatable tube shaft 10 is connected to an inner frustum of a double-conical casing 23, concentrically arranged relative to the outer casing 19. The casing 19 is connected to or provided with a tube-shaped outlet housing 20 having the outlet 21. The casing 19 is inwardly and the casing 23 outwardly provided with semi-spherical elements 22 extending into the space between the casings.

Figure 5:
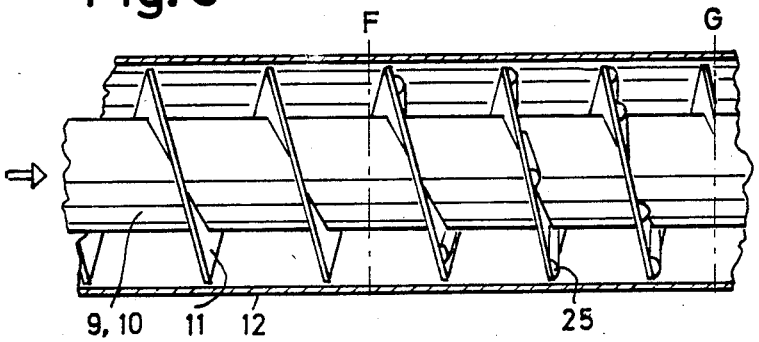
FIG. 5 illustrates a variant of the treatment step shown in FIG. 2.
Figure 6A:
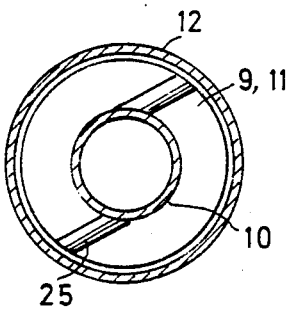
FIG. 6 illustrates different sections through the apparatus shown in FIG. 5.
Figure 6B:
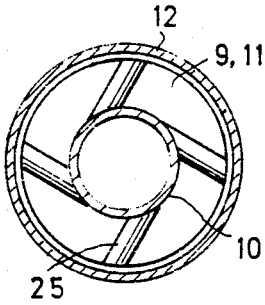
Figure 6C:
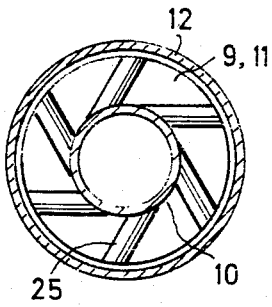

FIGS. 5 and 6, finally, illustrate another embodiment of the treatment zone F-G. The transport screw 9, consisting of the tube shaft 10 and the worm 11, is here extended into and through the treatment zone F-G. However, the pitch of the worm 11 within this treatment zone is successively decreased, ordinarily between 20–30%. Moreover, the worm is provided with substantially tangentially or radially directed rods or bars 25, preferably having semi-oval cross section. The number of the rods 25 is successively increasing from normally two rods at the inlet to the treatment zone to normally eight rods at the outlet from the zone.

The apparatus according to the invention as illustrated on the drawings is accordingly based on the use of substantially horizontal transport or feed screw 9, 10, 11 concentrically arranged in a casing or a mantle 12 and two subsequently following treatment steps F-G and G-H. The transport screw is arranged for receiving the pulp supplied through the inlet 13 and transport the pulp and give it an appropriate pressure ahead of the subsequent treatment step of the apparatus. The pulp can be supplied to the feed screw with positive pressure or with atmospheric pressure.

The first pulp treatment step in the preferred embodiment of the apparatus includes at least three radially extending annular elements 15 fixed to the mantle 12. The elements 15 have a substantially triangular cross section and are connected to each other with the radially directed fixed guide plates 16 extending in the direction of the longitudinal axis of the apparatus. The rotatable part or shaft 10 in the treatment step is likewise provided with corresponding radial elements 18 having a substantially triangular cross section, in number at least two and arranged between the annular elements 15 fixed to the mantle 12 and likewise provided with the radially directed longitudinal guide plates 17, both between the angular elements 18 and at the inlet into and the outlet out of the treatment step. The guide plates 15 on the mantle 12 are in number less than the number of rotating guide plates 17 but arranged such that at least two diametrically opposite guide plates 15 will coincide with at least two diametrically opposite guide plates 18 during short time intervals. This occurs with a periodicity determined by the angle difference between two guide plates 15 fixed to the mantle and the angle difference between two rotating guide plates 18. If, for instance, the number of fixed guide plates 15 is ten and the number of rotating guide plates 18 is twelve, the angle is between the fixed guide plates 36° and between the rotating guide plates 30°. The angle difference is in the example 6° and the periodicity thus 60 times per revolution. The pulp can upon these guide plates settings pass radially between the rotating and the fixed part only in the narrow gap space which in this position exists between closest behind fixed guide plate 15 and closest behind rotating guide plate 18, likewise at closest one in front. This means rapid repeated changes for the velocity gradients in the pulp in the entire cross section of the treatment step, further enforced by increasing and decreasing flow area in the treatment step, since the pulp flows alternatively outwardly towards the mantle 12 and inwardly towards the shaft 10 when flowing through the treatment step and guided by the radial annular elements 15 and 18 with their triangular cross section. The distance between the angular elements is in the illustrated preferred embodiment constant. The pulp passing through this treatment step is accordingly subjected to internal shearing forces between the fibre layers and kneading, caused by alternating velocity gradients in the fibre layers and the oscillating movement of the pulp in both axial and radial direction. The apparatus ordinary operates within the revolution range of 200–1500 r.p.m., which means that the oscillating movement of the pulp can have the frequency 12.000–90.000 times/minute.

After treatment in the treatment step F-G the pulp is moved to the final treatment step G-H in the apparatus as shown. In the final treatment step G-H the flow speed of the pulp is retarded during its passage from the inlet of the treatment step to the base of the double-cones 19, 23 at the same time as the periphery velocity of the rotating cone 23 is successively increased with the increased diameter of the cone. Thereafter the pulp is accelerated during its passage from the base of the double-cones towards the outlet of the treatment step, while the periphery velocity of the rotating cone 23 decreases. The retarding and accelerating movement of the pulp is enforced by the semi-spherical elements 22 to an oscillating pulp movement, wherein the pulp in the treatment step is subjected to a heavy shearing treatment further enforced of the kneading caused by the semi-spherical elements 22. In another embodiment the semi-spherical elements 22 can be replaced by ribs or rods having for instance triangular or semi-oval cross section. For lenient treatment of the pulp fibres all corners and edges should be well rounded.

For the supply of chemicals feed tubes 26 are positioned at appropriate places along the mantle 12 of the apparatus.

In an embodiment not shown the treatment steps can be invertedly positioned, i.e. the treatment step G-H be positioned ahead of the treatment step F-G in the transport direction of the pulp.

It shall be noted that for achieving the aimed treatment of a pulp both the fixed elements and the rotating elements in the apparatus can be shaped in another way. In certain cases, for instance for certain pulp concentrations, the kneading obtained in the apparatus as shown can be omitted, i.e. for instance the kneading obtained by the semi-spherical elements 22 i the treatment step G-H.

In a test plant for manufacturing ground pulp the pulp was bleached with 3% hydrogen peroxide and at a pulp concentration of 16%. Besides hydrogen peroxide 5% sodium water glass and 1.8% sodium hydroxide was charged. After two hours bleaching under these conditions a brightness of 79.5% according to SCAN-C 11:75 was obtained. The chemicals was mixed into the pulp with the aid of an ordinary pin mixer. In the demonstration test, the conventional mixing apparatus was replaced by an apparatus according to the present invention. The ground pulp was supplied to the inlet 13 of the apparatus and was transported further with the aid of the feed screw 9, 11 to the treatment step F-G. The dry content of the ground pulp was measured to 26% and its temperature to 63° C. In the treatment step F-G the pulp was subjected to rapidly pulsing treatment. The frequency was calculated to 24,000 times/minute. Simultaneously with this high frequent treatment, the pulp was in the treatment step F-G subjected to shearing and compressing treatment. After the passage through this treatment step, the pulp was pressed into the treatment step G-H, in which the pulp was subjected to very heavy shearing owing to obtained velocity gradients in this treatment step. Thus, the periphery speed in the beginning of the treatment step G-H at the shaft 10 was only a fourth of the periphery speed at the base of the rotating double-cone 23. The same was valid for the semi-spherical elements 22. After that the pulp has passed, the common base of the rotating double-cones, the periphery speed was again changed, this time in opposite direction. Simultaneously with the described shearing movement also a pulsing treatment was obtained in the treatment step G-H owing to the influence of the semi-spherical elements 22.

Bleaching chemicals was charged to the mixing apparatus via the feed tubes 26. The charge of peroxide amounted to 2.3%, sodium silicate (water glass) 4.5% and sodium hydroxide 1.7%. The amount of chemicals is calculated on dry amount ground pulp. By the dilution with the chemicals and accompanying water the pulp concentration was lowered from 26% to 24%.

The pulp mixed with chemicals was discharged from the mixing apparatus via its outlet 21. After washing of the pulp with water an analysis regarding brightness and paper technical qualities was carried out. Obtained values was compared with those obtained for a pulp treated in the the conventional mixing device. The results are tabulated in the following table.

TABLE

| | Ground pulp treated in conventional mixing apparatus | Apparatus according to the invention |
|---|---|---|
| Brightness ISO % | 79.5 | 81.2 |
| Tension index Nm/g | 35.7 | 39.8 |
| Tear Index $mNm^2 \cdot g$ | 3.4 | 3.9 |

The brightness was determined according to SCAN-C 11:75.

As appears from the table surprisingly good results have been obtained when using an apparatus according to the invention. Particularly surprising is the obtained high brightness. The result is still more remarkable considering the fact that the charge of bleaching chemicals was lower upon the bleaching according to the invention.

We claim:

1. An apparatus for mixing chemicals into ligno-cellulose materials, comprising fixed substantially horizontal casing, rotatable means within the casing, the rotatable means and casing together defining a flow space surrounding the rotatable means for providing a pulp flow path through the apparatus, first inlet means for admitting pulp to be treated to said space adjacent one end of said casing, outlet means for treated pulp positioned adjacent an opposite end of said casing, the casing defining at least three different treatment sections between the first inlet means and the outlet means, the rotatable means in first of said treatment sections which is positioned closest to the first inlet means including transport means for transporting the pulp to subsequent ones of the treatment sections with increased pressure, second inlet means for the supply of chemicals to said flow space in said first of said treatment sections, one of said subsequent treatment sections being provided in said flow space with guide means fixed on said casing and guide means fixed on said rotatable means for forming, upon rotation of aid rotatable means, a pulp flow channel between an entrance and an exit of said one of the subsequent treatment sections, said guide means fixed on the rotatable means extends outwardly towards the casing and said guide means fixed on the casing extends inwardly towards said rotatable means, said guide means fixed on the casing alternates in position along the length of said casing with respect to said guide means fixed on the rotatable means along the length of said rotatable means, thereby providing a shearing of the pulp during mixture of the pulp with chemicals supplied through said second inlet means, and another of said subsequent treatment sections having a first part with means for imparting to the pulp in said flow space a retarding velocity in a flow direction of the pulp and a second part positioned downstream of said first part with means for imparting to the pulp in said flow space an accelerating velocity in said flow direction, thereby providing pulses consisting of compressions and expansion of the pulp and velocity variations in the flow direction of the pulp.

2. An apparatus according to claim 1, wherein said guide means fixed on the casing and said guide means fixed on the rotatable means consist of annular elements extending from the casing and the rotatable means respectively a distance in the flow space and of platelike elements fastened between adjacent ones of said annular elements and arranged at a distance from each other along said annular elements.

3. An apparatus according to claim 2, wherein the number of platelike elements arranged on the rotatable device is greater than the number of the platelike elements arranged on the casing.

4. An apparatus according to claim 2, wherein said annular elements are in cross-section substantially triangular with equal sides and with the triangle top projected into said flow space.

5. An apparatus according to claim 1, wherein said guide means in said one subsequent treatment section are arranged and shaped to increase and decrease the flow area of said flow channel.

6. An apparatus according to claim 1, wherein said another of said subsequent treatment sections consist of a frustum of double-cones having the basis abutting each other, said casing consisting of an external double-cone and said rotatable means consisting of an internal double-cone.

* * * * *